US006447013B1

(12) United States Patent
Francesco

(10) Patent No.: US 6,447,013 B1
(45) Date of Patent: Sep. 10, 2002

(54) VOLUME WITH SEVERAL PAGES WITHOUT A BINDING MADE UP BY JOINING UP THE BACK FACES OF EACH PAIR OF FOUR PAGE SHEETS

(76) Inventor: De Marco Seo Francesco, S.S. 19bis Palazzo Grimoli, 87100 Cosenza (IT)

( * ) Notice: Subject to any disclaimer, the term of this patent is extended or adjusted under 35 U.S.C. 154(b) by 0 days.

(21) Appl. No.: 09/665,001

(22) Filed: Sep. 19, 2000

(30) Foreign Application Priority Data

Sep. 21, 1999 (IT) ..... RM990196 U

(51) Int. Cl.[7] ..... B42D 1/00
(52) U.S. Cl. ..... 281/21.1; 281/15.1; 281/38
(58) Field of Search ..... 281/15.1, 21.1, 281/22, 38, 45, 35; 283/63.1

(56) References Cited

U.S. PATENT DOCUMENTS 3,344,794 A * 10/1967 Mac Williams ..... 281/22 X
4,915,415 A * 4/1990 Sendor et al. ..... 281/15.1
5,403,138 A * 4/1995 Otake et al. ..... 281/22

* cited by examiner

*Primary Examiner*—Willmon Fridie, Jr.
(74) *Attorney, Agent, or Firm*—DeLio & Peterson, LLC

(57) ABSTRACT

A volume comprising a plurality of pages made from folded contiguous sheets. The volume includes joining together the external faces of the pages of the contiguous sheets to provide a plurality of pages without a spine binding. The volume may further include pages having sleeves on internal faces which are adapted to receive photographs.

14 Claims, 3 Drawing Sheets

VOLUME WITH SEVERAL PAGES WITHOUT A BINDING MADE UP BY JOINING UP THE BACK FACES OF EACH PAIR OF FOUR PAGE SHEETS

BACKGROUND OF THE INVENTION

1. Field of the Invention

The subject matter of the invention relates generally to a volume comprising several pages without any binding, and more particularly, to a volume made by joining together the back faces of each pair of four-page sheets.

2. Description of Related Art

In the binding field, not much has been done to try to make spines which would not split when they undergo ordinary use. The splitting of the spine is very common in volumes that contain pages quite thick as to say albums for photos, postcards, stamps and so on, due to the fact that in this case the sheets and the volume are heavier than in normal volumes.

Up to now, none of the different types of binding used has completely solved this problem, although spines were made up making use of thick textile strips glued to the spines with a quick setting adhesive.

Bearing in mind the problems and deficiencies of the prior art, it is therefore an object of the present invention to provide an absolutely resistant binding, which will not split even if it undergoes strong stresses as hanging an entire volume holding one page only between two fingers.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a plurality of contiguous sheets forming an album capable of holding together under stress. A plurality of pages are defined by outer edges of the sheets and a hinged portion traversing the sheets for folding the sheets. The sheets are preferably rectangularly shaped and the hinged portion is about a 90° angle from one of the outer edges. The sheets include at least four the pages, and the pages include an internal face and an external face having a bonding portion. The internal face may include a sleeve adapted to receive a photograph. The sheets are attached on the bonding portion of the external faces such that the outer edges of the pages are parallel, and the plurality of attached contiguous sheets form the album having a predetermined number of the pages.

A related embodiment of the present invention includes the internal faces of the pages including a first frame extending adjacent to the outer edges of the sheet. A second frame is attached to the first frame and adjacent to a perimeter of the first frame. The second frame has smaller dimensions than the first frame. The first and second frames are attached to the page adjacent to at least one of the outer edges of the sheet. The first and second frames define a gap between the first and second frames and the page for receiving the photograph.

In a related aspect the second frame includes a perimeter dimension which is less than the perimeter dimension of the first frame. The page has four edge portions defined by the outer edges of the sheet and the hinged portion. The first and second frames are attached to the page adjacent to three of the edge portions and unattached adjacent to a fourth edge portion. The unattached portion of the frame defines the gap along the fourth edge portion wherein the gap is dimensioned to receive the photograph. The gap may also be along a spine side of the album.

In another related aspect of the present invention the plurality of contiguous sheets may further include a cover joined to a back portion of the sheets, where the back portion includes the hinged portion of the pages.

Another aspect of the present invention provides a plurality of contiguous sheets being rectangularly shaped and forming an album capable of holding together under stress. A plurality of pages are defined by outer edges of the sheets and a hinged portion traversing the sheets at about a 90° angle from one of the outer edges for folding the sheets in about equal portions. The sheets include at least four pages, and the pages include an internal face and an external face having a bonding portion. The sheets are attached on the bonding portion of the external faces such that the outer edges of the pages are parallel and the plurality of attached contiguous sheets form the album having a predetermined number of the pages.

In a related embodiment of the present invention the internal faces of the pages include a first frame extending adjacent to the outer edges of the sheet. A second frame is attached to the first frame and adjacent to a perimeter of the first frame. The second frame has smaller dimensions than the first frame. The first and second frames are attached to the page adjacent to at least one of the outer edges of the sheet. The first and second frames define a gap between the first and second frames and the page for receiving a photograph.

In a related aspect of the present invention the second frame includes a perimeter dimension which is less than a perimeter dimension of the first frame. The page has four edge portions defined by the outer edges of the sheet and the hinged portion. The first and second frames are attached to the page adjacent to three of the edge portions and is unattached adjacent to a fourth edge portion. The frames define the gap along the fourth edge portion wherein the gap is dimensioned to receive the photograph. The gap for receiving the photograph may be along a spine side of the album.

In another related aspect of the present invention the plurality of contiguous sheets may further including a cover joined to a back portion of the sheets where the back portion includes the hinged portion of the pages.

Yet another aspect of the present invention provides a method of creating an album capable of holding together under stress comprising a plurality of rectangularly shaped contiguous sheets. The sheets are folded to provide a hinged portion and a plurality of pages having about equal dimensions. The pages are defined by outer edges of the sheets and the hinged portion which traverses the sheets. The hinged portion may be about a 90° angle from one of the outer edges. The sheets include at least four of the pages, and the pages include an internal face and an external face having a bonding portion. The sheets are attached on the bonding portion of the external faces such that the outer edges of the pages are parallel. The plurality of attached contiguous sheets form the album having a predetermined number of the pages.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
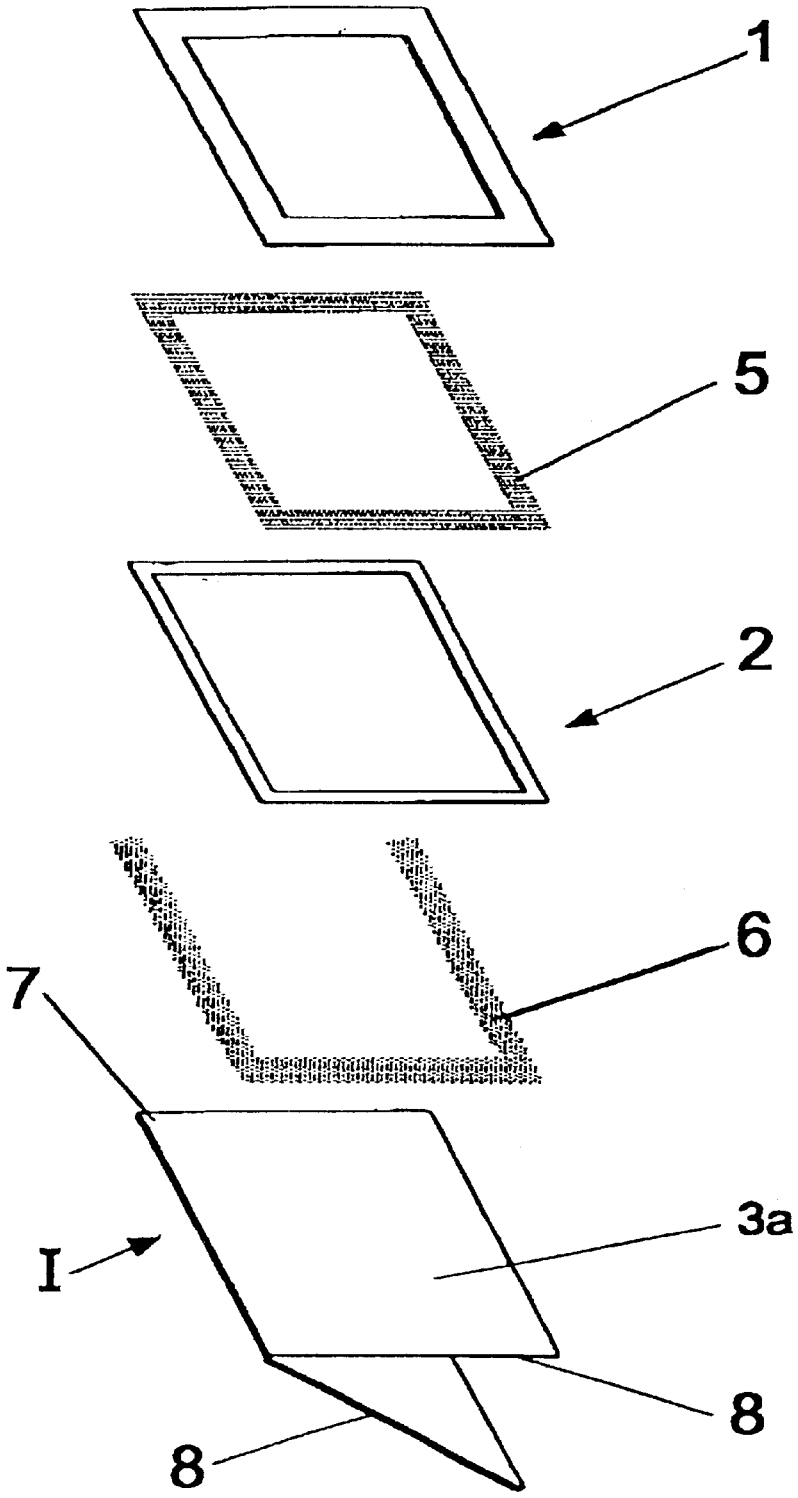
FIG. 1 is a perspective view of a four page-sheet and the outer and inner frames which will be glued thereto.

In describing the preferred embodiments of the present invention, reference will be made herein to FIGS. 1–4 of the drawings in which like numerals refer to like features of the invention. Features of the invention are not necessarily shown to scale in the drawings.

An advantage of a volume made using the present invention is that this kind of binding is obtained by acting on contiguous pages and not on the back (spines) of sheets.

According to the invention, the volume is formed by sticking together the external contiguous faces of each pair of four pages sheets, so joining to together all the sheets forming a volume, album and the like, having a preset number of pages.

In a particular embodiment, but not exclusively therein, a volume constituted according to the invention is made and structured in order to set up an album for photos and it is in this particular version that it will be now described and illustrated in the annexed drawings.

As can be seen, each page face of the album containing a photo has a peripheral frame having the same dimensions and sizes of the page, which frame runs along the edge of the free sides thereof and is stuck to three of these sides. A similar frame, but having narrower sides is inserted between each edge of the sheet and the corresponding side of the larger side frame.

The frame, having a narrower sides, acts as a spacer forming a gap or space between the main frame and the page receiving the photo and permits an easy sliding in of the photo therein; obviously, the photo slides in correspondence of the side of the frame which is not glued to the sheet.

It must be remembered that here the photo can be inserted from any side even from the spine side which is not possible in conventional albums.

Figure 2:
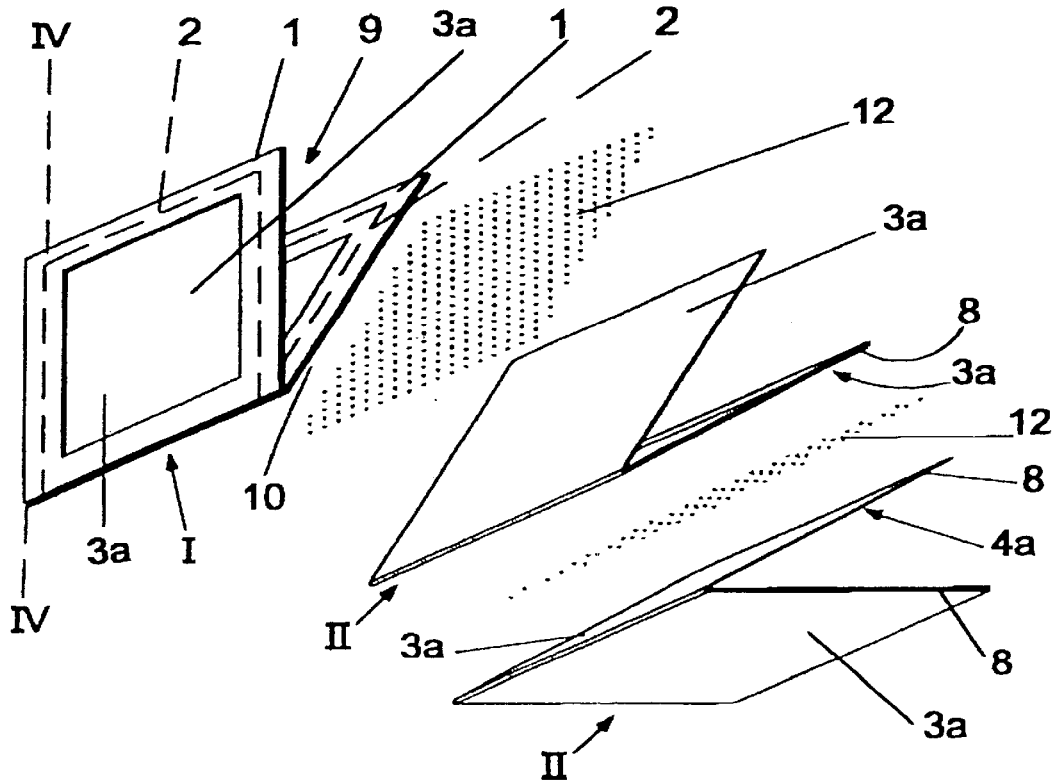
FIG. 2 is a perspective view in a larger scale of a group of three four- page sheets that shows how the sheets are joined together by through gluing.

With reference to FIGS. 1 and 2 the sticking of the two frames (FIG. 2) is shown. They are indicated by references 1 and 2 and it also shows the joining of a group of three sheets (FIG. 2) by sticking their external pages by a layer of glue indicated by reference number 12. The sheets are indicated by references I, II, III, and the external pages, which must be glued together, by reference 3*a*.

Figure 3:
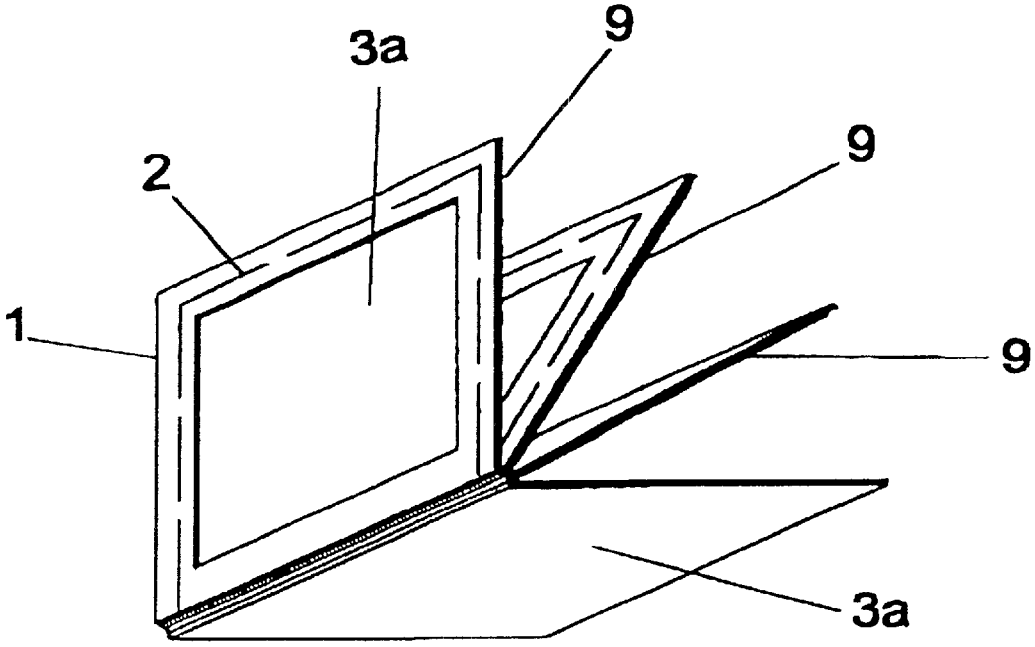
FIG. 3 is a similar view that shows the two sheets of FIG. 2 glued together.

As can clearly be seen, frames 1 and 2 are firstly glued together using a strong adhesive for gluing paper and cardboard and it is indicated by reference 5, then they are glued to the external face 4*a* of page 1, which is made up by two sheets glued together and already provided with the pair of frames as shown in FIG. 3 by reference 9. On the other hand the edges of each pair of glued sheets, not yet provided with frames 1 and 2, are indicated by reference 8.

Figure 4:
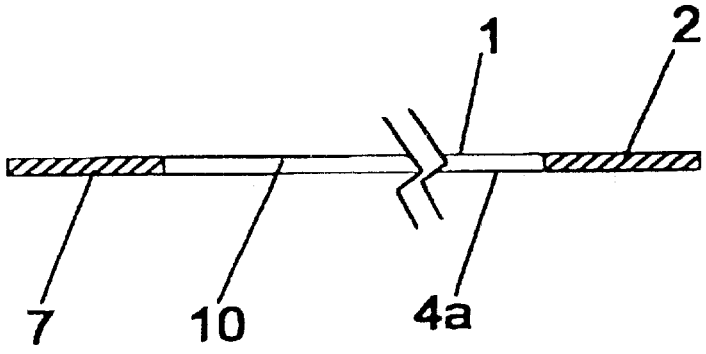
FIG. 4 is the section (IV—IV-FIG. 2) of sheet seen from the opening edge; it also shows the superimposition of the frame having wider sides over the narrower sides frame and how they are glued thereto.

From FIG. 1, showing how the adhesive layer 6 is placed in a U shape, between the pair of frames 1 and 2 and external face 4*a*, it is now clear how in the upper edge 7 of the page an opening 10 is formed where the frames 1 and 2 are not glued and through which opening it is possible to slide in a picture; the opening 10 and the way it is formed can be seen in detail in FIG. 4. In the album just described, the opening 10 of every sheet is placed on the upper edge 7 (FIG. 1). Obviously, it is possible to change the position of the opening edge simply by changing the position of not glued sides of frames 1 and 2.

Summarizing, every volume or album made up according to the invention, is formed by several pages and every page is made up by two sheets belonging to two contiguous four-page sheets, glued together.

In this embodiment intended to form an album for photos in which on the two faces of each page, having usually a square form, there is a double frame made up by two superimposed frames, glued together but having sides of different width (larger for the external and narrowers for the internal frame). In doing so, on the fourth side not glued an opening will be formed which permits the sliding of the photo onto the page. The inside frame placed between the external frame and the page makes a thin gap in which the photo will be received.

It will be now clear that this type of union between all the sheets that makeup the album provides a very strong structure in which the union of many pages is not made on the spine of the album. Obviously, the album will be supplied with a cover, for instance of leather joined to the spine of the sheets in a traditional way.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plurality of contiguous sheets forming an album capable of holding together under stress, which comprises:

a plurality of pages defined by outer edges of said sheets and a hinged portion traversing said sheets for folding said sheets, at least one of said pages including an internal face and at least one of said pages including an external face having a bonding portion; and said sheets being attached on said bonding portion of said external faces such that said outer edges of said pages are parallel, and said plurality of contiguous sheets are attached to form said album having a predetermined number of said pages.

2. The plurality of contiguous sheets of claim 1 further including a sleeve adapted to receive a photograph, said sleeve being attached to said internal face of said page.

3. The plurality of contiguous sheets of claim 1 wherein said internal face of said page includes a first frame extending adjacent to said outer edges of said sheet; and a second frame attached to said first frame and adjacent to a perimeter of said first frame, said second frame having smaller dimensions than said first frame, said first and second frames being attached to said page adjacent to at least one said outer edges of said sheet, and said first and second frames defining a gap between said first and second frames and said page for receiving a photograph.

4. The plurality of contiguous sheets of claim 3 wherein said second frame includes a perimeter dimension which is less than a perimeter dimension of said first frame; and said page having four edge portions defined by said outer edges of said sheet and said hinged portion, and said first and second frames being attached to said page adjacent to three said edge portions and being unattached adjacent to a fourth edge portion which defines said gap along said fourth edge portion wherein said gap is dimensioned to receive said photograph.

5. The plurality of contiguous sheets according to claim 1 wherein said gap for receiving said photograph is along a spine side of said album.

6. The plurality of contiguous sheets according to claim 1 further including a cover joined to a back portion of said sheets, said back portion including said hinged portion of said pages.

7. The plurality of contiguous sheets according to claim 1 wherein said sheets are rectangularly shaped and said hinged portion is about a 90° angle from one of said outer edges.

8. A plurality of contiguous sheets being rectangularly shaped and forming an album capable of holding together under stress, which comprises:

a plurality of pages defined by outer edges of said sheets and a hinged portion traversing said sheets at about a 90° angle from one of said outer edges for folding said sheets in about equal portions, said pages including an internal face and an external face having a bonding portion; and said sheets being attached on said bonding portion of said external faces such that said outer edges of said pages are parallel, and said plurality of contiguous sheets are attached to form said album having a predetermined number of said pages.

9. The plurality of contiguous sheets of claim 8 wherein said internal faces of said pages include a first frame extending adjacent to said outer edges of said sheet; and a second frame attached to said first frame and adjacent to a perimeter of said first frame, said second frame having smaller dimensions than said first frame, said first and second frames being attached to said page adjacent to at least one said outer edge of said sheet, and said first and second frames defining a gap between said first and second frames and said page for receiving a photograph.

10. The plurality of contiguous sheets of claim 9 wherein said second frame includes a perimeter dimension which is less than a perimeter dimension of said first frame; and said page having four edge portions defined by said outer edges of said sheet and said hinged portion, and said first and second frames being attached to said page adjacent to three said edge portions and being unattached adjacent to a fourth edge portion which defines said gap along said fourth edge portion wherein said gap is dimensioned to receive said photograph.

11. The plurality of contiguous sheets according to claim 8 wherein said gap for receiving said photograph is along a spine side of said album.

12. The plurality of contiguous sheets according to claim 8 further including a cover joined to a back portion of said sheets, said back portion including said hinged portion of said pages.

13. A method of creating an album capable of holding together under stress comprising:

providing a plurality of rectangularly shaped contiguous sheets;

folding said sheets to provide a hinged portion and a plurality of pages having about equal dimensions, said pages being defined by outer edges of said sheets and said hinged portion which traverses said sheets, said pages including an internal face and an external face having a bonding portion; and attaching said sheets on said bonding portion of said external faces such that said outer edges of said pages are parallel, and said plurality of contiguous sheets are attached to form said album having a predetermined number of said pages.

14. The method of claim 13 wherein said hinged portion is about a 90° angle from one of said outer edges.

* * * * *

UNITED STATES PATENT AND TRADEMARK OFFICE

CERTIFICATE OF CORRECTION

PATENT NO. : 6,447,013 B1
DATED : September 10, 2002
INVENTOR(S) : Leo Francesco De Marco It is certified that error appears in the above-identified patent and that said Letters Patent is hereby corrected as shown below:

Title page,
Item [75], Inventor: delete "De Marco Seo Francesco" and insert
-- Leo Francesco De Marco --

Column 1,
Line 44, delete "The sheets include at least four pages, and the" and substitute therefor
-- The --.

Column 2,
Line 16, delete "sheets include at least four pages, and the" and substitute therefor
-- plurality of --.
Line 57, delete "sheets include at least four pages, and the" and substitute therefor
-- plurality of --.

Column 3,
Line 31, after "external" delete "contiguous faces of each pair of four pages sheets, so joining to together all the sheets forming a volume," and substitute therefor -- faces of pages of a plurality of contiguous sheets. Joining together all the sheets forms a volume, or --.
Line 40, delete "As can be seen, each" and substitute therefor -- Each --.
Line 42, delete "page, which" and substitute therefor -- page. The --.
Line 45, delete "each" and substitute therefor -- the --.
Line 52, delete "It must be remembered that here the" and substitute therefor -- The --.
Line 56, after "sticking" insert -- together --.
Lines 57 and 61, after "by" delete "references" and substitute therefor
-- reference numbers --.
Line 58, after "2" delete "and it also" and insert -- , which --.
Line 59, after "pages" insert -- 3a --.
Line 65, after "reference" insert -- number --.
Line 61, after "II," insert -- and --.
Line 66, after "page 1" insert -- . --.
Line 66, delete "which" and substitute therefor -- Page 1 --.

UNITED STATES PATENT AND TRADEMARK OFFICE

CERTIFICATE OF CORRECTION

PATENT NO. : 6,447,013 B1 
DATED : September 10, 2002
INVENTOR(S) : Leo Francesco De Marco It is certified that error appears in the above-identified patent and that said Letters Patent is hereby corrected as shown below:

Column 4,
Lines 1 and 3, after "reference" insert -- numeral --.
Line 4, delete "From" and substitute therefor -- Referring to --.
Line 4, after "Fig. 1," delete "showing how".
Line 6, delete "it is now clear how in" and substitute therefor -- In --.
Line 9, delete "picture; the" and substitute therefor -- picture. The --.
Line 13, delete "not glued" and substitute therefor -- the unglued --.
Line 14, after "of" insert -- the --.
Line 15, delete the following paragraph:
"Summarizing, every volume or album made up according to the invention, is formed by several pages and every page is made up by two sheets belonging to two contiguous four-page sheets, glued together" and substitute therefor -- Summarizing, volumes or albums made up according to the invention are formed by several contiguous sheets I, II, III having attached external pages 3a. Further, referring to Figs. 1 and 2, a sheet I is folded creating a hinge which traversed the sheet. Once folded, the sheet preferably includes four pages, two pages with internal faces 4a, and two pages with external faces 3a. A plurality of pages may be glued together at their external faces forming a plurality of contiguous sheets affixed together providing the volume. --.
Line 19, after "In" delete "this" and substitute therefor -- another --.
Line 19, after "photos" insert -- , -- and delete "in which on".
Line 21, after "form," delete "there is" and substitute therefor -- includes --.
Line 22, after "frames" delete "," and insert -- , -- after "together".
Line 24, delete "not glued" and substitute therefor -- which is un-glued, --.
Line 31, delete "makeup" and substitute therefor -- makes up --.

Signed and Sealed this

Twenty-eighth Day of January, 2003

JAMES E. ROGAN
*Director of the United States Patent and Trademark Office*